United States Patent [19]

Rao

[11] 4,374,649

[45] Feb. 22, 1983

[54] FLAME ARRESTOR

[75] Inventor: Subbarao N. Rao, Ridgewood, N.J.

[73] Assignee: Burns & Roe, Inc., Oradell, N.J.

[21] Appl. No.: 233,769

[22] Filed: Feb. 12, 1981

[51] Int. Cl.[3] ..... F17D 3/00; B01F 3/04

[52] U.S. Cl. ..... 48/192; 220/88 R; 261/123; 261/124; 376/300

[58] Field of Search ..... 48/192; 261/123, 124; 220/88 R; 376/279, 300

[56] References Cited

U.S. PATENT DOCUMENTS

| | | | |
|---|---|---|---|
| 2,157,914 | 5/1939 | Ness | 48/192 |
| 3,429,676 | 2/1969 | Gatza | 261/123 |
| 3,754,740 | 8/1973 | Piper | 261/124 |
| 3,953,555 | 4/1976 | Gley | 261/124 |
| 4,217,316 | 8/1980 | Germerdonk | 48/192 |

FOREIGN PATENT DOCUMENTS

| | | | |
|---|---|---|---|
| 228733 | 7/1909 | Fed. Rep. of Germany | 261/123 |
| 424202 | 2/1935 | United Kingdom | 48/192 |

*Primary Examiner*—Peter F. Kratz

*Attorney, Agent, or Firm*—Fitzpatrick, Cella, Harper & Scinto

[57] ABSTRACT

A flame arrestor is disclosed which includes a conduit extending along inside of a drum arranged to contain a quantity of non-combustible liquid. This conduit is equipped with bubbler nozzles that discharge a combustible gas into the liquid in the form of separate, discrete bubbles. The gas is drawn from the drum through outlets above the liquid level and deflectors are positioned to deflect and distribute a flame front entering the drum through any of the nozzles.

4 Claims, 5 Drawing Figures

FLAME ARRESTOR

BACKGROUND OF THE INVENTION

1. Field of the Invention

This invention relates to flame arrestors, and more particularly to such devices for arresting the progress of flame having deflagration or detonation characteristics.

2. Description of the Prior Art

Flame arrestors of both the hydraulic and dry type are known which can function to arrest the progression of low velocity flame, that is, flame with a progression rate of the order of 10 ft/sec. as are generated by relatively pure fuels and solvents such as acetylene, propane, ether and the like. Thus, for example, U.S. Pat. No. 1,770,341 discloses a back pressure gas valve used to suppress low velocity flame as might be encountered in low pressure fuel-gas supply lines. Other U.S. patents and publications of interest are Nos. 2,157,914 and 2,352,256 which disclose the utilization of check and relief valves, No. 1,825,970 which discloses the use of a double acting valve, No. 3,472,419 which discloses a liquid barrier trap system, and Flame Arrestors for High-Hydrogen Fuel-Air Mixtures, Howard, Rodehorst and Small, 1975, Loss Prevention Symposium, American Institute of Chemical Engineering.

It is known that mixtures of hydrogen and oxygen when burned, produce an exceedingly high detonation temperature and pressure and consequent damage, where uncontrolled, with a progression rate of the order of 10,000 ft/sec. Thus, it is seen that the characteristics of such an occurrence are quite distinct from those mentioned above, wherefore the arresting of such combustion requires entirely different considerations.

SUMMARY OF THE INVENTION

I have conceived, constructed and successfully tested a flame arrestor in which detonation flame of one of the most combustible mixtures of hydrogen and oxygen (66% $H_2$ at a flow rate of 15SCFM and 34% $O_2$ at a flow rate of 7.5SCFM) has been completely arrested without damage. Thus, my novel flame arrestor finds application, for example, between the condenser and the hydrogen and oxygen recombiner in a nuclear power generating facility. An additional advantage of the present invention resides in the fact that it is effective with a low pressure drop relative to known arrestors so that it is more energy efficient.

Thus, the flame arrestor of the present invention typically comprises a drum or a pressure vessel or the like for containing a predetermined quantity of fluid, closure means at each end of the drum for closing the same, conduit means disposed within the drum and extending through one of the drum closure means, bubbler means associated with the conduit means at a level below the fluid level in the drum, and outlet means in the drum above the fluid level therein.

I prefer that the longitudinal axis of the drum and the conduit means be horizontal with the conduit means extending substantially the full length of the drum. The bubbler means may include a nozzle with a nipple having an aperture for effecting fluid flow communication between the interior of the conduit means and the drum below the fluid level thereof.

As stated, the nozzle means includes a nipple having an aperture for effecting fluid flow communication between the interiors of the conduit means and the drum, and I provide a horizontally disposed baffle plate above the nipple, and flash distribution means between the outlet means and the fluid level in the drum.

Actually, I prefer to provide a plurality of nozzle means in association with the upper region of the conduit, each nozzle means having a plurality of spaced, horizontally bored apertures, and a baffle plate above each nozzle means, all for a purpose later to be described.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein.

DESCRIPTION OF THE PREFERRED EMBODIMENTS

Figure 1:
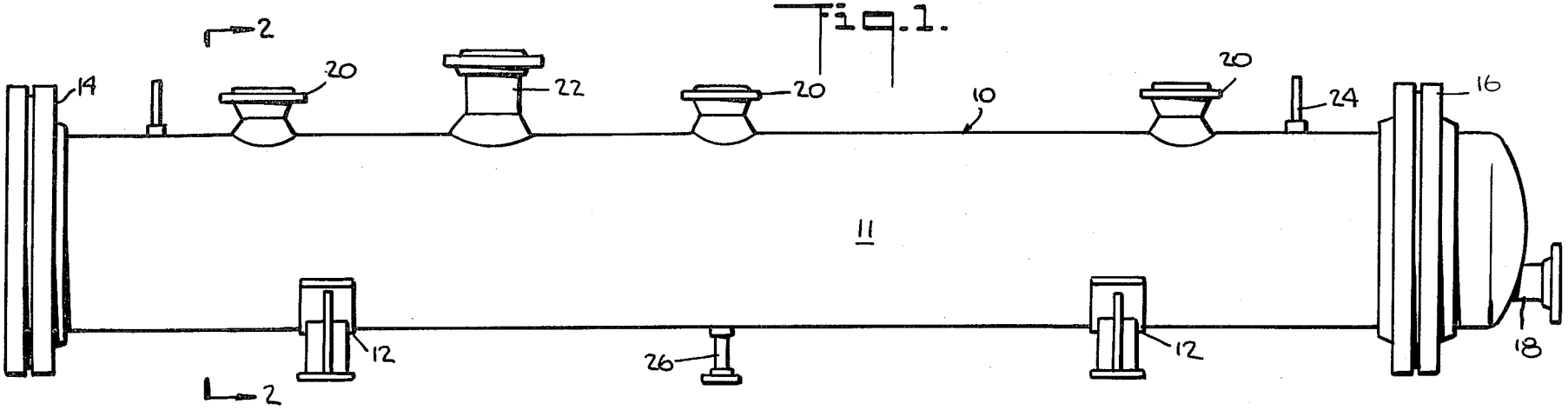
FIG. 1 is an elevational view of a flame arrestor according to the present invention.

Turning now to FIG. 1, there is shown a flame arrestor 10 according to the present invention and which includes an elongate drum 11 which may be supported by spaced saddles 12 and which has sealing closures 14 and 16 at respective ends thereof for closing the same. A conduit 18 extends through the closure 16 and into the drum. Gas outlet nozzles 20 are provided at intervals along the top of the drum surface for conducting gas from the drum as are at least one pressure relief and inspection fitting 22 and makeup water connectors 24, while a drain fitting 26 is provided on the bottom of the drum.

Figure 3B:
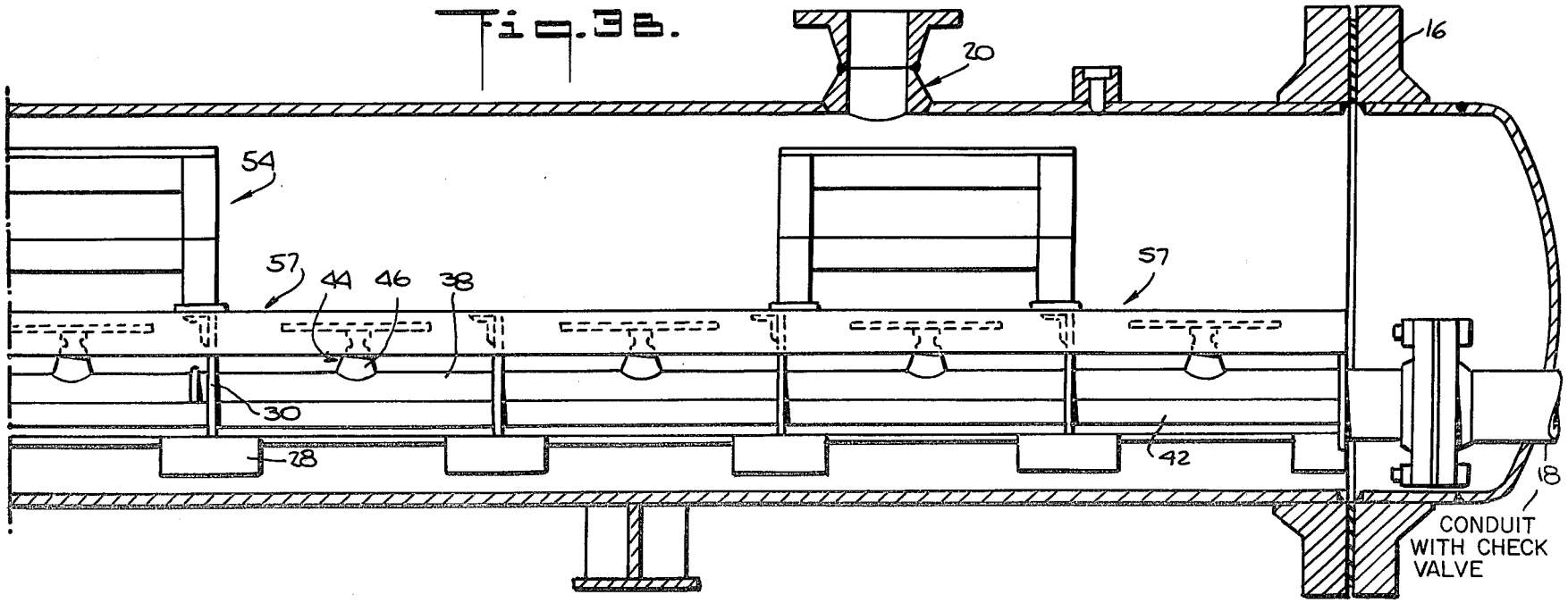
FIGS. 3A and 3B are connecting sections of a cross-sectional view taken along the line 3A,B of FIG. 2.
Figure 2:
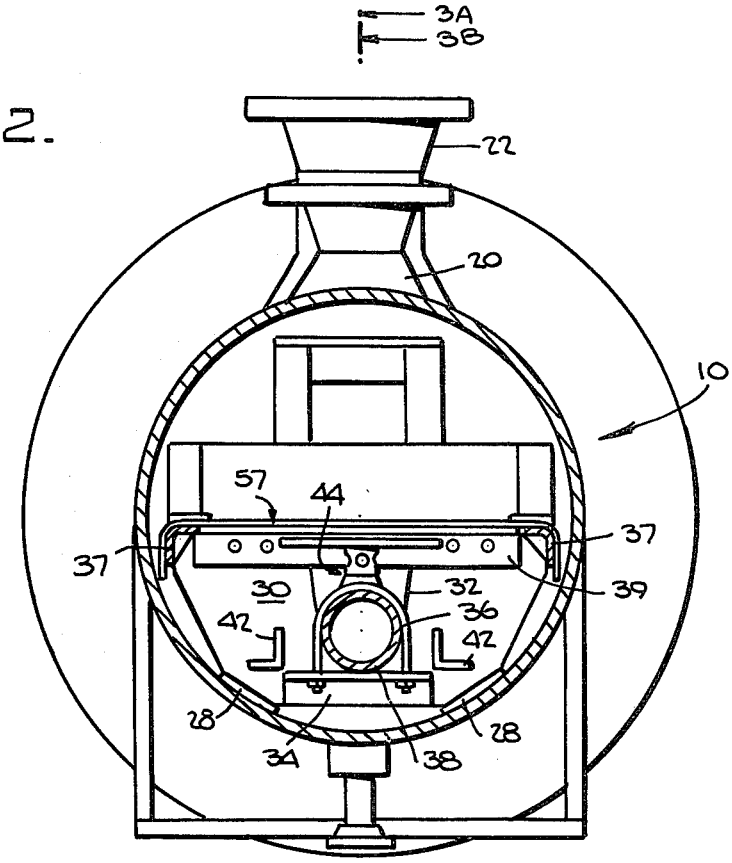
FIG. 2 is a cross-sectional view taken along the line 2—2 of FIG. 1.
Figure 3A:
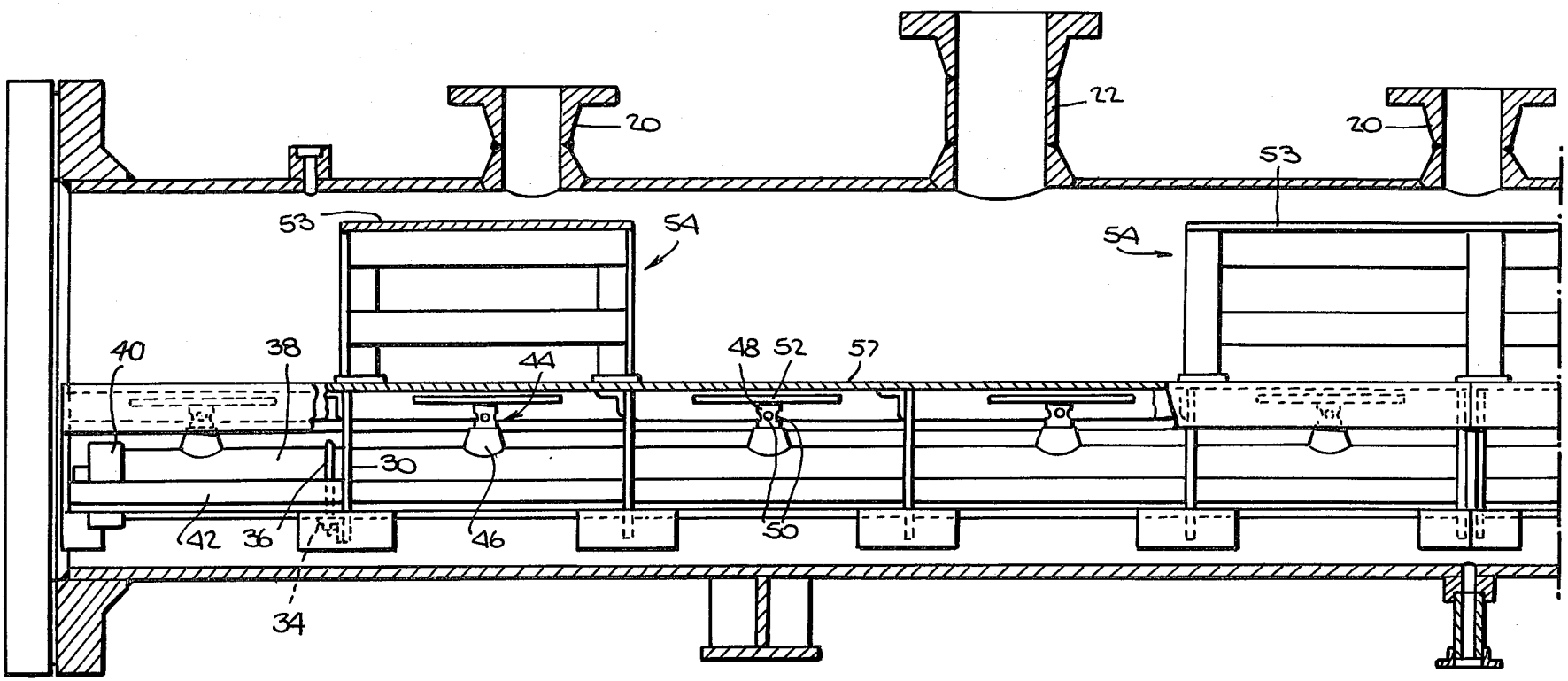

As shown in FIGS. 2, 3A and 3B, the interior of the drum is provided with a series of conduit supported assemblies comprising longitudinally spaced pairs of support 28, the shoes of each pair being positioned on opposed lower quarters of the drum wall and serving to support an upstanding support plate 30 formed with a central, generally U-shaped recess 32. At least one side of each support plate 30 is provided with clamping bars 34 each having a horizontally disposed flange at the level of the bottom of its adjacent recess 32 and suitably bored to receive the ends of U-bolts 36 by which an elongate conduit 38 is fixedly supported within the drum 11, extending the length thereof and elevated somewhat above the bottom of the drum. As seen in FIG. 3A, the conduit 38 is capped and sealed as at 40, viewed at the left side of the FIG., and extends through the closure 16 shown at the right side of FIG. 3B for connection to a supply of combustible gas. Each support plate 30 may be braced by a pair of angle irons 42 extending between adjacent plates one on each side of the conduit 38, and reinforced by channel irons 37 across the top and partially along the sides thereof and gussetted at its corners, as well as by horizontally reinforcing plates 39 bolted or riveted thereto and extending across the open end of the recess 32.

At equally spaced intervals along the top surface of the conduit 38, and preferably between each support plate 30, I provide a bubbler nozzle 44 which may take the form of an upstanding conical section welded to the conduit 38, a cylindrical section 48 extending upwardly of the conical section and formed with a plurality of radial openings 50 therein, and a flat baffle plate 52 horizontally disposed atop the cylindrical section.

The bubbler nozzles effect communication between the interior of the conduit 38 and the drum 11 through the conical and cylindrical sections and the openings 50. I have achieved complete flame quenching of one of the most combustible mixture of $H_2$ and $O_2$ utilizing bubbler nozzles having four openings 50 of $\frac{1}{4}''$ diameter spaced 90° apart in a 1" pipe and with centers $1\frac{1}{8}''$ below the $\frac{1}{4}''$ thick baffle plate 52 of 9" diameter, and about $6\frac{1}{4}''$ above the center of 4" conduit 38. A perforated plate 57, supported by the angles 37, redirects the gas from the baffle plate 52. I have provided $\frac{1}{8}''$ diameter staggered perforations on $\frac{3}{4}''$ separations.

A deflector 54 is positioned beneath each gas outlet nozzle 20 and may consist of a suitable supporting frame for a horizontally disposed plate 53 arranged in the drum above the conduit 38 for a purpose to be described, and I also provide means, such as a check valve in the conduit 38 to prevent the flow of fluid from the drum through the conduit.

Figure 4:
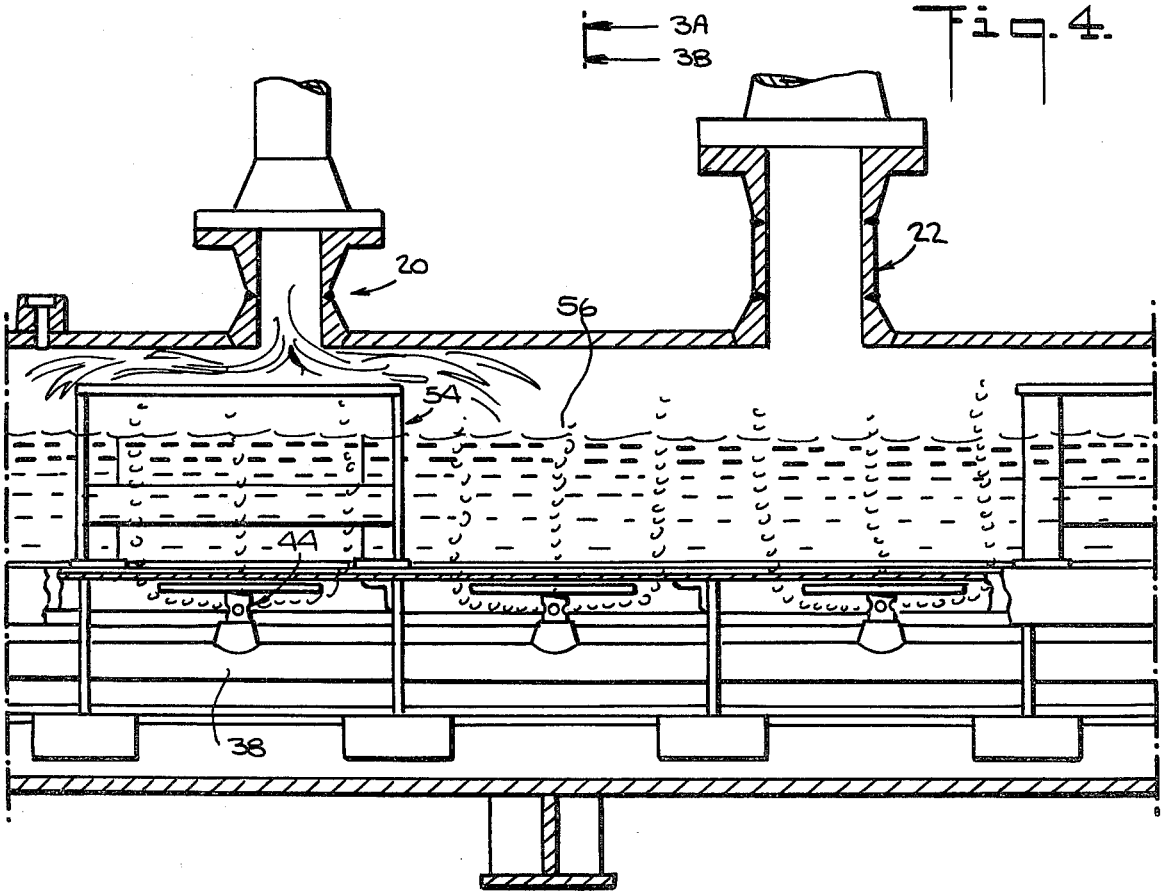
FIG. 4 is an enlarged portion of a cross-sectional view similar to FIGS. 3A and 3B but illustrating the arrestor in operating condition.

In operation, the drum is filled with water or a suitable non-combustible fluid to a level as indicated by the reference numeral 56 in FIG. 4. A combustible gas, such as a mixture of hydrogen and oxygen, is delivered to the conduit 38 through which it is conducted to the bubbler nozzles 44. The gas is discharged into the water through the openings 50 in the form of discrete bubbles which rise and are separated by the baffle plates 52 to rise further in the water to the space above the liquid level 56 from which the gas is drawn from the drum through the outlet nozzles 20. The perforated plate 57 also serves to improve the size and discreteness of bubbles.

In the event of ignition of the gas downstream of the drum, a flame front having deflagration and detonation characteristics travels rapidly toward the flame arrestor drum, entering it through the gas outlet nozzles 20. The plates 52 deflect and distribute the flame as it enters the drum thereby also distributing the impact pressure wave in the flame front as well as the radiation heat transfer to protect the system against concentrated impact and heat load at local points.

As the thus distributed flame front reaches the liquid level 56 in the drum, it is quenched due to heat removal effected by the liquid and especially by the fact that the gas bubbles are isolated from one another with the water or other non-combustible liquid separating them along the extended path of liquid-gas contact from the nozzle openings 50, upwardly to the plates 52, outwardly beneath the plates 52 and upwardly through the perforated plate 57 and the liquid to the liquid level 56, the bubbles being well separated by relatively large volumes of water by the time they reach the water surface.

From the foregoing description, it will be seen that I have contributed a flame arrestor by which I am able to quench detonation flame of the most combustible mixture of gas without damage to the system and that the present arrestor is effective with a low pressure drop relative to that of other systems known to me so that it is more energy efficient.

I believe that the construction and operation of my novel flame arrestor will now be understood and that the several advantages thereof will be fully appreciated by those persons skilled in the art.

I claim:

1. A flash arrestor comprising:

a drum containing a perdetermined quantity of fluid;

a closure means at each end of the drum for closing the same;

conduit means disposed within said drum and extending through one of said closure means;

bubbler means associated with the upper region of said conduit means at a level below the fluid level in said drum;

wherein the longitudinal axes of said drum and said conduit means are parallel and horizontal, said conduit means extending substantially the full length of said drum and said bubbler means includes a nipple having an aperture for effecting fluid flow communication between the interior of said conduit means and said drum below the fluid level thereof and a solid baffle plate horizontally disposed above said nipple and below the fluid level, arranged to disperse said bubbles horizontally beneath the fluid level in said drum, and a perforated plate is disposed within said drum below the fluid level and above said solid baffle plate; and Outlet means in said drum above the fluid level therein wherein flash distribution means are provided between said outlet means and the fluid level in said drum.

2. A device according to claim 1, wherein means are provided in said conduit to prevent the flow of liquid from the drum through said conduit.

3. A flash arrestor comprising:

an elongate closed drum containing a predetermined quantity of non-combustible liquid;

means supporting said drum with its longitudinal axis in a horizontal plane;

a conduit within said drum and extending parallel to and throughout the length thereof;

means for connecting said conduit with a source of combustible gas under pressure outside of said drum;

a plurality of nozzles spaced along and projecting from said conduit at a level below the liquid level in said drum and each having a plurality of apertures for effecting a flow of gas from said conduit to the interior of said drum below the liquid level therein in the form of discrete bubbles; and a solid baffle plate above each nozzle further to disperse and control the size of said bubbles horizontally beneath the liquid level in said drum and a perforated plate is disposed within said drum below the fluid level and above said baffle plate; and outlet means in said drum above the liquid level therein for conducting gas above the liquid level from said drum, and wherein a horizontal plate is disposed in said drum between said outlet means and the liquid level to deflect flame entering said drum from said outlet means

4. A device according to claim 3 wherein means are provided in said conduit to prevent the flow of liquid from the drum through said conduit.

* * * * *